US009091205B2

(12) United States Patent
Santos

(10) Patent No.: US 9,091,205 B2
(45) Date of Patent: Jul. 28, 2015

(54) ROCKER ARM ACCESSIBILITY COVER ASSEMBLY

(76) Inventor: Ruben Santos, Spring Hill, FL (US)

( * ) Notice: Subject to any disclaimer, the term of this patent is extended or adjusted under 35 U.S.C. 154(b) by 385 days.

(21) Appl. No.: 13/457,488

(22) Filed: Apr. 27, 2012

(65) Prior Publication Data

US 2013/0284144 A1 Oct. 31, 2013

(51) Int. Cl.

| | |
|---|---|
| ***F02B 77/04*** | (2006.01) |
| ***F02B 77/08*** | (2006.01) |
| ***F02F 7/00*** | (2006.01) |
| *F02B 77/00* | (2006.01) |
| *F01L 1/18* | (2006.01) |

(52) U.S. Cl.

CPC ..... *F02B 77/082* (2013.01); *F02B 77/083* (2013.01); *F02F 7/006* (2013.01); *F01L 1/18* (2013.01); *F01L 2103/01* (2013.01); *F01L 2800/17* (2013.01); *F02B 77/00* (2013.01)

(58) Field of Classification Search

CPC ..... F02F 7/006; F02F 7/0065; F02F 7/0068; F02B 77/00; F02B 77/082; F02B 77/083; F01L 1/18; F01L 2103/01; F01L 2800/17

USPC ..... 123/90.37–90.38, 195 C, 198 E; 29/888.06

See application file for complete search history.

(56) References Cited

U.S. PATENT DOCUMENTS

| | | | | | |
|---|---|---|---|---|---|
| 1,874,338 | A | * | 8/1932 | Niven | 123/90.38 |
| 2,607,331 | A | * | 8/1952 | Wefing | 123/90.38 |
| D217,314 | S | | 4/1970 | Smith | |
| 3,568,799 | A | * | 3/1971 | Bivins | 184/6.27 |
| 3,773,142 | A | | 11/1973 | Bragg et al. | |
| 3,822,763 | A | | 7/1974 | Adams et al. | |
| 3,870,024 | A | | 3/1975 | Ridgeway | |
| 4,388,898 | A | * | 6/1983 | Larson | 123/90.38 |
| 4,538,560 | A | * | 9/1985 | Alden | 123/90.38 |
| 4,608,950 | A | * | 9/1986 | Payne et al. | 123/195 C |
| 4,788,950 | A | * | 12/1988 | Finley | 123/195 C |
| 5,095,860 | A | * | 3/1992 | Newell | 123/90.38 |
| 5,197,447 | A | | 3/1993 | Dick | |
| 5,228,419 | A | | 7/1993 | Nonogawa | |
| 5,253,907 | A | | 10/1993 | Schnoor et al. | |
| 5,492,086 | A | * | 2/1996 | Kuhns | 123/90.38 |
| 5,560,265 | A | | 10/1996 | Miller | |
| 5,884,594 | A | * | 3/1999 | Wiehle | 123/90.38 |

(Continued)

OTHER PUBLICATIONS

EricTheCarGuy, "How to Find a Noise", Internet, uploaded Sep. 12, 2010; retrieved from the internet Jun. 9, 2014 at http://www.youtube.com/watch?v=6mpNRJ7m-c8.*

*Primary Examiner* — Hung Q Nguyen
(74) *Attorney, Agent, or Firm* — Boag Law, PLLC

(57) ABSTRACT

A rocker arm cover providing diagnosis and repair access to the rocker arm while the engine is running. The rocker arm is also capable of protecting a rocker arm from contacting other components of the engine, reducing contamination, and inhibiting oil and fluids from dispersing. The casing includes a multiplicity of access holes positioned along the casing, and positioned for accessing the rocker arm. A plurality of removable caps and joining mechanisms cover the access holes. Upon removal of the caps and joining mechanisms, a listening device with a diaphragm may be utilized to listen for specific rattling sounds associated with a loose rocker arm, or other valve in the cam system. After this diagnosis, a fastening device may be utilized to engage and adjust the rocker arm, rocker arm fasteners, or the intake and exhaust valves linked to the rocker arm.

15 Claims, 2 Drawing Sheets

(56) References Cited

U.S. PATENT DOCUMENTS

| | | | | |
|---|---|---|---|---|
| 6,098,583 | A * | 8/2000 | Gordon | 123/90.38 |
| 6,298,814 | B1 | 10/2001 | Pearlman et al. | |
| 6,345,436 | B1 * | 2/2002 | Codrington | 29/720 |
| D574,853 | S | 8/2008 | Harbert | |
| 7,789,079 | B2 | 9/2010 | Harbert | |
| 8,056,522 | B1 * | 11/2011 | Carter | 123/90.38 |
| 2009/0241879 | A1 | 10/2009 | Harbert | |

* cited by examiner

ROCKER ARM ACCESSIBILITY COVER ASSEMBLY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to engine covers. More particularly, one or more embodiments of the invention relate to rocker arm covers and methods for adjusting rocker arms.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Rocker arm covers are usually included in internal combustion engines. The rocker arm cover protects at least one rocker arm from contacting other engine parts or fluids. Typically, the rocker arm cover must be removed in order to adjust a rocker arm which occasionally become loose and ineffective or dangerous. Removal of the rocker arm cover may be time consuming. Additionally, removal of the rocker arm cover may create a mess, often requiring further time to clean. Sometimes, small parts included in a rocker arm cover may be easily misplaced as well.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
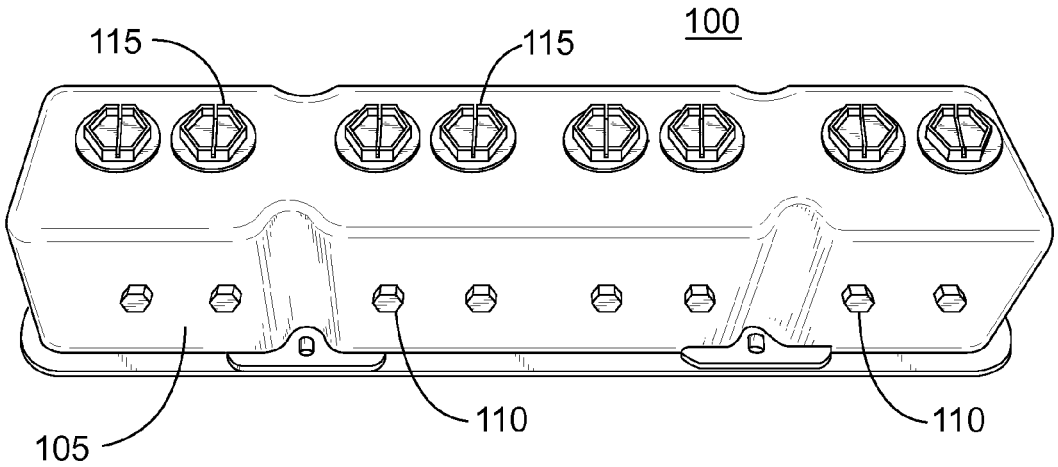
FIG. 1A is a view of an exemplary rocker arm cover according to an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Figure 1B:
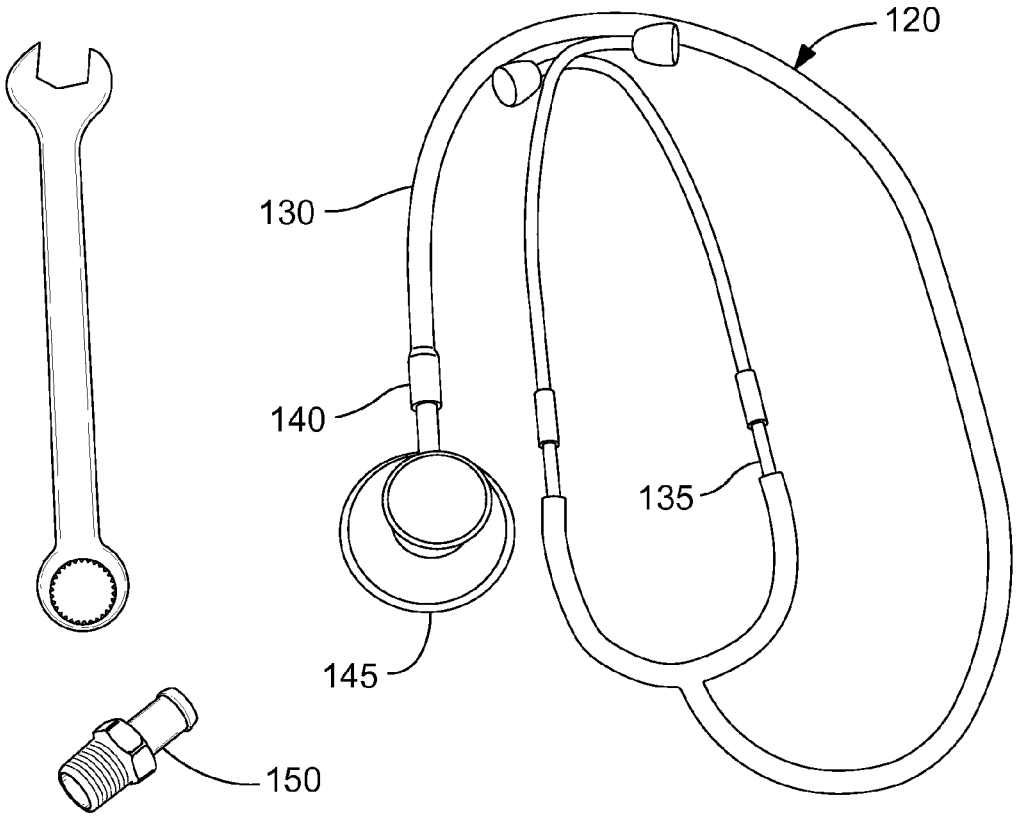
FIG. 1B is a view of an exemplary listening device according to an embodiment of the present invention.
Figure 1C:
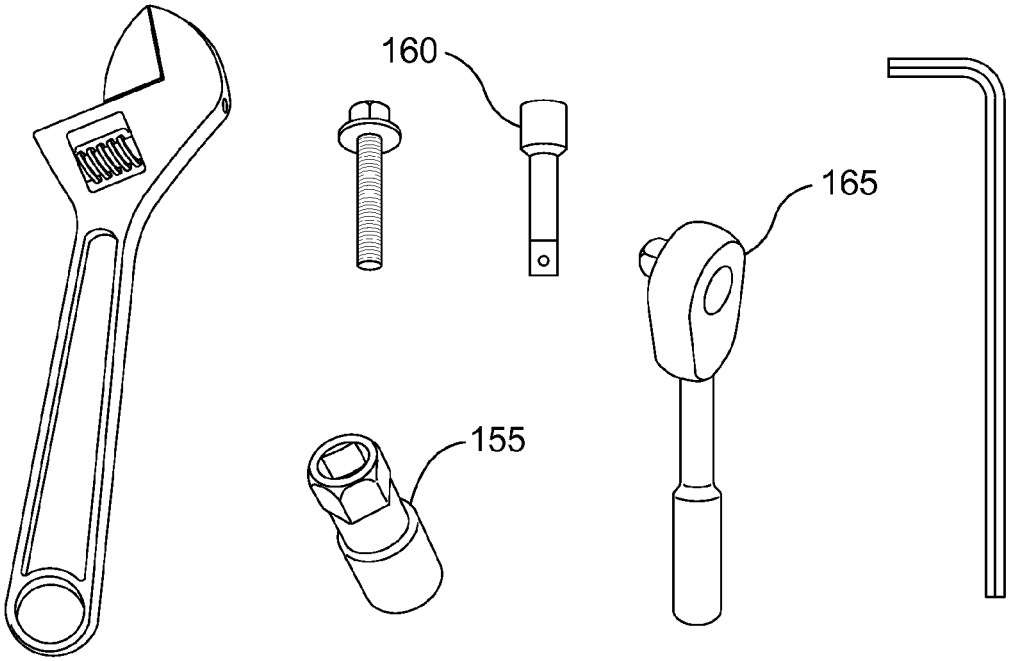
FIG. 1C is a view of an exemplary fastening device according to an embodiment of the present invention.

A rocker arm cover 100 is described in FIGS. 1A through 1C. The rocker arm cover provides diagnosis and repair access to the rocker arm while the engine is running. The rocker arm cover, as described in one embodiment, also protects a rocker arm from contacting other components of the engine, prevents contaminants from contacting the rocker arm, and inhibits oil and fluids from dispersing from the general area of the rocker arm. In one embodiment, a rocker arm casing is bolted over at least one rocker arm. The casing includes a multiplicity of access holes positioned along the casing, and designed for accessing the rocker arm. The present invention allows access to the rocker arm through the access holes, even while the engine is running. At least one cap covers the access holes, and is removable. Upon removal, a listening device may be applied over the access hole to listen for abnormalities in the rocker arm. Those skilled in the art can appreciate that a listening device with a diaphragm may be utilized to listen for specific rattling sounds associated with a loose rocker arm, or other valve in the cam system. At least one joining mechanism covers other access holes in the casing. Upon removal of the joining mechanism, a fastening device may be utilized to engage and adjust the rocker arm, rocker arm fasteners, or the intake and exhaust valves linked to the rocker arm. Those skilled in the art, in light of the present teachings, will recognize that various different fastening devices may be utilized including, but not limited to a spark plug wrench, socket wrench, allen wrench, screw driver, and the like.

By way of example and not limitation, the cap removes to provide access to the rocker arm while the engine is running. A diaphragm from the listening device may then position over the access hole to detect irregular sounds from the rocker arm. Simultaneously, the joining mechanism removes to allow a fastening device with an extension portion access within the rocker arm cover. A ratchet attached to the extension portion then allows a rocker arm fastener to be tightened in one direction. This process also may occur while the engine is running with minimal concern for safety or loss of oil and fluids from the rocker arm.

FIG. 1A is a view of an exemplary rocker arm cover 100 according to an embodiment of the present invention. The rocker arm cover 100, includes a casing 105 and a joining mechanism 110. Suitable materials for the casing 105 include, but are not limited to, a silicone, a polypropylene, a polyvinylchloride, a plastic, a plastic, rubber, a metal, copper, steel, and aluminum. In one embodiment, the casing may be secured over the rocker arm with a variety of rocker arm fasteners including, but not limited to a bolt, a nut, and a washer. The casing securely positions over the rocker arm and the surrounding valves to protect against contaminants and prevent oil and fluids from discharging.

Further embodiments of the exemplary FIG. 1A illustrate that a suitable joining mechanisms include, but are not limited to, lug nuts, pop-rivets, bolts, nuts, screws, adhesives, and clamps. In some embodiments, the joining mechanism may include a first diameter. Suitable ranges for the first diameter include, but are not limited to ⅜ inches. In some embodiments, the joining mechanism may include a cap 115. The cap 115 may be removably joined to the joining mechanism 110. Suitable materials for the cap 115 include, but are not limited to, a silicone, a polypropylene, a polyvinylchloride, a plastic, a plastic, rubber, a metal, copper, steel, and aluminum. In many embodiments, the cap 115 may be removably joined to the casing 105. In some embodiments, the casing 105 includes a void. In many embodiments, a rocker arm may be disposed in the void. In some embodiments, the rocker arm may be joined to an engine.

FIG. 1B is a view of an exemplary listening device 120 according to an embodiment of the present invention. Suitable listening devices include, but are not limited to, a stethoscope, a microphone, a speaker, and an amplifier. In some embodiments, the listening device 120 may be used to detect a loose rocker arm. The listening device 120 may include a conduit 130 in many embodiments. Suitable materials for the conduit 130 include, but are not limited to, a silicone, a polypropylene, a polyvinylchloride, a plastic, a plastic, rubber, a metal, copper, steel, and aluminum. In many embodiments, the conduit may include a first end 135 and a second end 140. A diaphragm 145 may be removably joined to the second end 140. In many embodiments, the diaphragm 145 is removed from the second end 140. The second end may have a second diameter. Suitable ranges for the second diameter include, but are not limited to ¼ inches. In many embodiments, the listening device 120 may include a fitting 150. The fitting 150 may be inserted into the second end 140 in some embodiments. Suitable materials for the fitting 150 include, but are not limited to, a silicone, a polypropylene, a polyvinylchloride, a plastic, a plastic, rubber, a metal, copper, steel, and aluminum. The fitting may have a third diameter. Suitable ranges for the third diameter include, but are not limited to ¼ inches.

FIG. 1C is a view of an exemplary fastening device according to an embodiment of the present invention. In some embodiments, the fastening device may include a fastening device 155. Suitable materials for the fastening device 155 include, but are not limited to, a silicone, a polypropylene, a polyvinylchloride, a plastic, a plastic, rubber, a metal, copper, steel, and aluminum. In many embodiments, the fastening device 155 may include a fourth diameter. Suitable ranges for the fourth diameter include, but are not limited to ⅝ inches. In some embodiments, the fastening device may include an extension portion 160. The fastening device 155 may be removably joined to the extension portion 160 in many embodiments. Suitable materials for the extension portion 160 include, but are not limited to, a silicone, a polypropylene, a polyvinylchloride, a plastic, a plastic, rubber, a metal, copper, steel, and aluminum. The extension portion 160 may have a fifth diameter. Suitable ranges for the fifth diameter include, but are not limited to ⅜ inches. In some embodiments, the fastening device may include a ratchet 165. In many embodiments, the extension portion 160 may be removably joined to the ratchet 165. Suitable materials for the ratchet 165 include, but are not limited to, a silicone, a polypropylene, a polyvinylchloride, a plastic, a plastic, rubber, a metal, copper, steel, and aluminum. The ratchet 165 may have a sixth diameter. Suitable ranges for the sixth diameter include, but are not limited to ⅜ inches.

In many embodiments, the cap 115 may be removed from the casing 105. In some embodiments, the joining mechanism 110 may be removed from the casing 105. Suitable tools for removing the cap 115 or the joining mechanism 110 include, but are not limited to a wrench, an adjustable wrench, an allen wrench, and a crescent wrench. In many embodiments an aperture may be created in the casing when the joining mechanism is removed. In some embodiments, the fastening device may be inserted into the aperture. The fastening device may contact the rocker arm in some embodiments. In many embodiments, the fastening device may be used to loosen or tighten the rocker arm.

Depending upon the needs of the particular application, some embodiments in accordance with the present invention may also include a method for detecting a loose rocker arm and tightening the rocker arm. In accordance with this method a listening device may be used to detect a loose rocker arm. In some embodiments, the fitting may be inserted into the second end of the conduit. In some embodiments, the cap may be removed from the casing. In many embodiments, the joining mechanism may be removed from the casing. The fastening device may be inserted into the aperture in some embodiments. In many embodiments, the fastening mechanism may be used to tighten or loosen the rocker arm. In some embodiments, after the rocker arm is adjusted, the fastening mechanism may be removed from the aperture. The joining mechanism may be inserted into the aperture in some embodiments. In many embodiments, the cap may be joined to the casing. In some embodiments, the engine may be running.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing engine covers according to the present invention will be apparent to those skilled in the art. The invention has been described above by way of illustration, and the specific embodiments disclosed are not intended to limit the invention to the particular forms disclosed. The particular implementation of the engine covers may vary depending upon the particular context or application. By way of example, and not limitation, the engine covers described in the foregoing were principally directed to rocker arm covers and methods for adjusting rocker arms implementations; however, similar techniques may instead be applied to covers for other engine parts and devices for adjusting other engine parts, which implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A rocker arm cover comprising:

a casing, said casing being configured to cover at least one rocker arm;

at least one access hole defined in said casing, wherein said access hole is fitted with a sleeve;

at least one cap removably mated with said access hole and said sleeve; and at least one joining mechanism removably inserted into at least one joining mechanism opening formed on said casing.

2. The rocker arm cover of claim 1, wherein said sleeve is heat resistant.

3. The rocker arm cover of claim 1, wherein said sleeve is configured to inhibit the dispersal of fluids from an underside of said casing when the device is in use.

4. The rocker arm cover of claim 1, wherein said sleeve includes threads that mate with threads on said cap.

5. The rocker arm cover of claim 1 where in said access hole is configured to engage a head of a listening device.

6. The rocker arm cover of claim 1, wherein said at least one joining mechanism opening is configured to receive said adjusting device.

7. A method of identifying and correcting misalignment of a rocker arm comprising:

removing a cap from an access hole defined in a rocker arm casing, said access hole comprising a sleeve;

removing a joining mechanism from a joining mechanism opening;

applying a listening device to said access hole;

using said listening device to detect misalignment;

inserting an adjusting device into said joining mechanism opening; and using said adjusting device to perform corrective adjustment.

8. The method of claim 7 wherein said access hole is fitted with said sleeve, said sleeve being configured to inhibit the dispersal of fluids from an underside of said casing when the device is in use.

9. The method of claim 7 wherein said listening device comprises a first end and a second end, said second end comprising a diaphragm configured to amplify detection of movement of said at least one rocker arm.

10. The method of claim 7 wherein said adjusting device is a ratchet.

11. A system for identifying and correcting misalignment of a rocker arm comprising:

a rocker arm cover;

a listening device; and a fastening device;

wherein said rocker arm cover comprises a casing, at least one access hole defined in said casing, at least one cap removably mated with said access hole; and at least one joining mechanism removably inserted into at least one joining mechanism opening formed on said casing.

12. The system of claim 11 wherein said access hole is fitted with a sleeve, said sleeve being configured to inhibit the dispersal of fluids from an underside of said casing when the device is in use.

13. The system of claim 11 wherein said listening device comprises a first end and a second end, said second end comprising a diaphragm configured to amplify detection of movement of said at least one rocker arm.

14. The system of claim 11 wherein said listening device comprises a conduit that is insulated from thermal energy.

15. The system of claim 11 wherein said adjusting device is a ratchet.

* * * * *